US009630765B1

(12) United States Patent
Nelson

(10) Patent No.: US 9,630,765 B1
(45) Date of Patent: Apr. 25, 2017

(54) COMBINATION DEODORANT/ANTIPERSPIRANT AND MOIST WIPES CONTAINER

(71) Applicant: Georgina Nelson, New Smyrna Beach, FL (US)

(72) Inventor: Georgina Nelson, New Smyrna Beach, FL (US)

( * ) Notice: Subject to any disclaimer, the term of this patent is extended or adjusted under 35 U.S.C. 154(b) by 60 days.

(21) Appl. No.: 15/088,766

(22) Filed: Apr. 1, 2016

Related U.S. Application Data

(60) Provisional application No. 62/178,449, filed on Apr. 10, 2015.

(51) Int. Cl.

| | |
|---|---|
| ***B65D 83/08*** | (2006.01) |
| ***A47K 10/42*** | (2006.01) |
| ***A45D 40/04*** | (2006.01) |
| *A47K 10/32* | (2006.01) |

(52) U.S. Cl.
CPC ..... *B65D 83/0805* (2013.01); *A45D 40/04* (2013.01); *A47K 10/426* (2013.01); *A47K 2010/3266* (2013.01)

(58) Field of Classification Search
CPC combination set(s) only.
See application file for complete search history.

(56) References Cited

U.S. PATENT DOCUMENTS

| | | | | |
|---|---|---|---|---|
| 1,556,245 | A * | 10/1925 | Newlon | A45D 27/04 132/290 |
| 3,212,509 | A * | 10/1965 | De Kolb | A45D 33/003 206/229 |
| 5,024,546 | A * | 6/1991 | Guzman | A45D 40/262 401/16 |
| 6,321,937 | B1 * | 11/2001 | DeSimone | A47K 10/3818 221/45 |
| 6,986,355 | B2 * | 1/2006 | Byun | A45D 33/006 132/287 |
| 7,226,227 | B2 * | 6/2007 | Gueret | A45D 34/06 132/317 |
| 7,585,125 | B2 * | 9/2009 | Muhlhausen | B65D 23/12 401/123 |
| 8,496,108 | B2 | 7/2013 | Bahcall | |
| 8,540,117 | B2 | 9/2013 | Andrews et al. | |
| 8,684,184 | B2 | 4/2014 | Moskow | |
| 8,979,409 | B2 * | 3/2015 | Ulrich | A45D 34/06 132/294 |
| 2008/0047921 | A1 | 2/2008 | Klabbers et al. | |
| 2011/0210039 | A1 | 9/2011 | Alongi | |

FOREIGN PATENT DOCUMENTS

| | | |
|---|---|---|
| WO | 2005068308 | 7/2005 |

* cited by examiner

*Primary Examiner* — David Walczak
(74) *Attorney, Agent, or Firm* — Brian S. Steinberger; Law Offices of Brian S. Steinberger, P.A.

(57) ABSTRACT

Devices, apparatus, systems and methods for combining a container with wipes and a deodorant dispenser. The hand held combination deodorant/antiperspirant and moist wipes container can have dual compartments, and can be vertically stacked and joined together by a coupler. The upper compartment can house the deodorant/antiperspirant product, and include an advance mechanism which raises or lowers the contents to dispense. The lower compartment can house wipes. Both compartments can have an opening through which the contents can be accessed and a cover to protect the product. The upper and lower compartments can be configured to release from each other. Alternatively, the compartments can be made inseparable from one another. The invention can be sized in order to attach and detach existing prior art deodorant dispensers from the wiper dispenser housing. Other types of toiletries and healthcare products can be used with the invention.

18 Claims, 14 Drawing Sheets

10
20
30
35
40
50
60
70
79
80
90
100
130
130/140
140
150
160
190

COMBINATION DEODORANT/ANTIPERSPIRANT AND MOIST WIPES CONTAINER

RELATED APPLICATIONS

This invention claims the benefit of priority to U.S. Provisional Patent Application Ser. No. 62/178,449 filed Apr. 10, 2015, which is incorporated by reference in its' entirety.

FIELD OF INVENTION

This invention relates to deodorants and wipes, and in particular to devices, apparatus, systems and methods for combining a container with wipes and a deodorant dispenser.

BACKGROUND AND PRIOR ART

It is common for men and women of all ages to use deodorant/antiperspirant to keep themselves and their clothing sweat and odor proof free. Applying deodorant after showering or bathing generally works for this purpose. But it's those times when a shower is not possible due to circumstances or time restraints that something else is required.

We've all been in stressful situations where we race from one activity to the next in hopes that our deodorant is still working. We go from commuting to work, to racing back to the office after our lunch break. We often leave work and meet friends or go to the gym. Then we stop at the market to buy groceries and on the way home pick up the kids from their after school activities. Always on the go with no time to shower between tasks.

There was a time when you could take along a deodorant dispenser, go into the nearest restroom, use their paper towels and soap and wash your underarms. Then you could reapply your deodorant and along with it a feeling of restored freshness and confidence. However those opportunities have all but vanished with the advent of the electronic hand dryer. As their popularity has grown finding paper towels in restrooms has become a challenge. Without the availability of paper towels we're often faced with the dilemma of not being able to adequately take care of our perspiration issues in public restrooms.

Other inventors have attempted to resolve this problem. U.S. Pat. No. 8,540,117 compartmentalizes four body wash wipes in a single kit as a substitute for showering or bathing. Attempting to solve multiple body issues exclusively using wipes would not be efficient. U.S. Pat. No. 8,496,108 describes a body wash system including a moist wipe and a dry wipe for cleansing the body. Two wipes would not be sufficient to wash the entire body and would require more than one product application. However, none of the prior art solves all the problems of having to separately purchase and/or carry and/or store deodorants and wipes.

SUMMARY OF THE INVENTION

A primary objective of this invention is to provide devices, apparatus, systems and methods for combining a container with wipes and a deodorant dispenser.

A secondary objective of this invention is to provide devices, apparatus, systems and methods for providing the ability to cleanse ones underarms and apply deodorant/antiperspirant wherever and whenever it's needed, and eliminates the necessity to search for a public restroom that still supplies paper towels, in that everything required for deodorant/antiperspirant application is available in one convenient container.

A third objective of this invention is to provide devices, apparatus, systems and methods for combining deodorant/antiperspirant and moist wipes in one convenient container, which is handheld, portable and compact.

A fourth objective of this invention is to provide devices, apparatus, systems and methods for providing a single container for deodorant/antiperspirant and moist wipes, that can be carried in a handbag, gym bag, back pack, brief case, or stowed in a locker or a glove compartment.

A dual compartment container can include an upper compartment for housing a deodorant, with a dispensing port, a lower compartment for housing a plurality of wipes, and fasteners for attaching the upper compartment to the lower compartment to form a dual compartment container capable of being held in one's hand.

The fasteners can include a male member having exterior threads and a female member having internal socket threads, wherein the male member screws into the female member to attach the upper compartment to the lower compartment.

The fasteners can include a male member having at least one exterior snap on rib, and a female member having at least one internal snap on rib, wherein the male member snapably attached into the female member to attach the upper compartment to the lower compartment.

The dual compartment container can include a removable cover for covering a top opening in the upper compartment to allow the deodorant to be dispensed therefrom, and a side access door covering a side dispensing opening in the lower compartment for allowing the wipes to be individually dispensed therefrom.

The dual compartment container can include a rotatable wheel for controlling the dispensing of the deodorant. The dual compartment container can include a slidable lever for controlling the dispensing of the deodorant.

The upper compartment can include a generally oval configuration with rounded top cover. The upper compartment can include a generally tubular configuration with rounded top cover.

The lower compartment can include an upper portion having a diameter substantially identical to a diameter of the upper compartment and tapering outward to a convex side portions adjacent to a base portion.

The upper and lower compartment can have any shape, such as rectangular, square, polygon, tubular, cylindrical, and the like.

The dual compartment can include a loading door on a bottom of the lower container for loading wipes into the lower container.

A dual deodorant and wipes device can include a handheld container having separate chambers attachable and detachable from one another, the separate chambers for storing and dispensing deodorant and wipes therefrom.

The handheld container further can include a removable cover on top of the container for covering deodorant and for allowing deodorant to be dispensed therefrom and a side door on a side of the container for allowing the wipes to be dispensed therefrom.

The handheld container can include a bottom access door on the bottom of the container for allowing the wipes to be loaded into the wipes chamber. The handheld container can include mateable threadable fasteners for allowing the separate containers to screw onto one another or unscrew and separate from one another.

The handheld container can include snapable ribs for allowing the separate containers to snap onto one another or unsnap and separate from one another.

Further objects and advantages of this invention will be apparent from the following detailed description of preferred embodiments which are illustrated schematically in the accompanying drawings.

DESCRIPTION OF THE PREFERRED EMBODIMENTS

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

In the Summary above and in the Detailed Description of Preferred Embodiments and in the accompanying drawings, reference is made to particular features (including method steps) of the invention. It is to be understood that the disclosure of the invention in this specification includes all possible combinations of such particular features. For example, where a particular feature is disclosed in the context of a particular aspect or embodiment of the invention, that feature can also be used, to the extent possible, in combination with and/or in the context of other particular aspects and embodiments of the invention, and in the invention generally.

In this section, some embodiments of the invention will be described more fully with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will convey the scope of the invention to those skilled in the art. Like numbers refer to like elements throughout, and prime notation is used to indicate similar elements in alternative embodiments.

A list of components will now be described.

Figure 2:
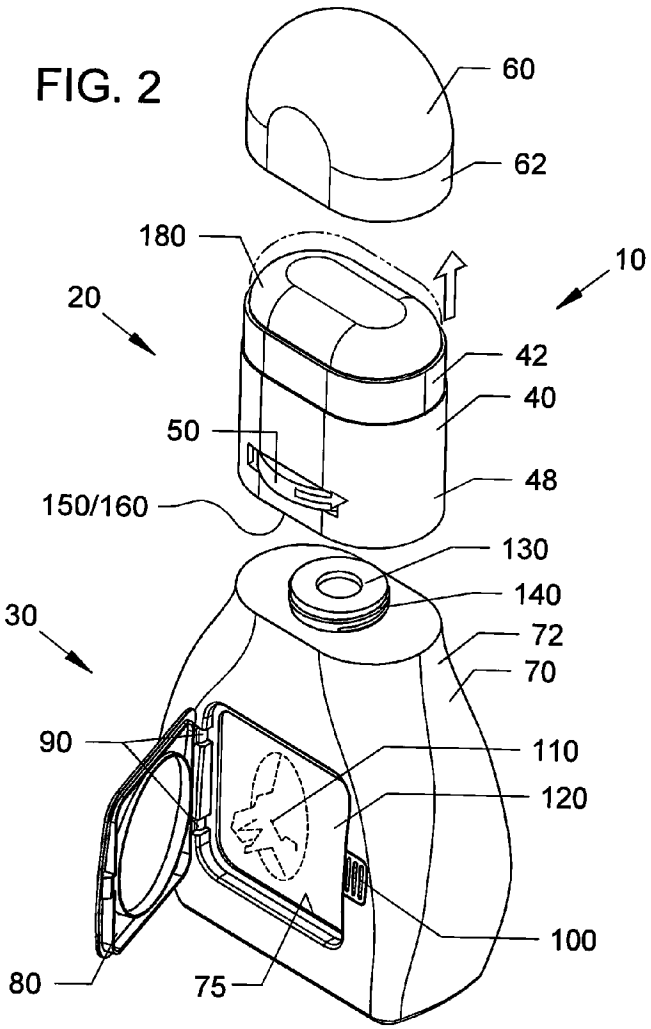
FIG. 2 is an exploded perspective view of the dual dispenser assembly of FIG. 1.
Figure 1:
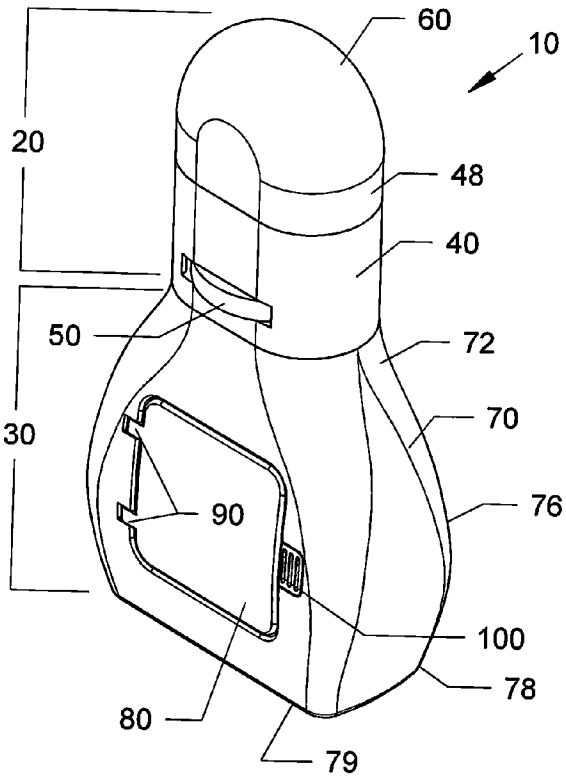
FIG. 1 is an upper front right perspective view of a dual dispenser assembly, with one access door in the front where moist wipes can be loaded and dispensed.
Figure 4:
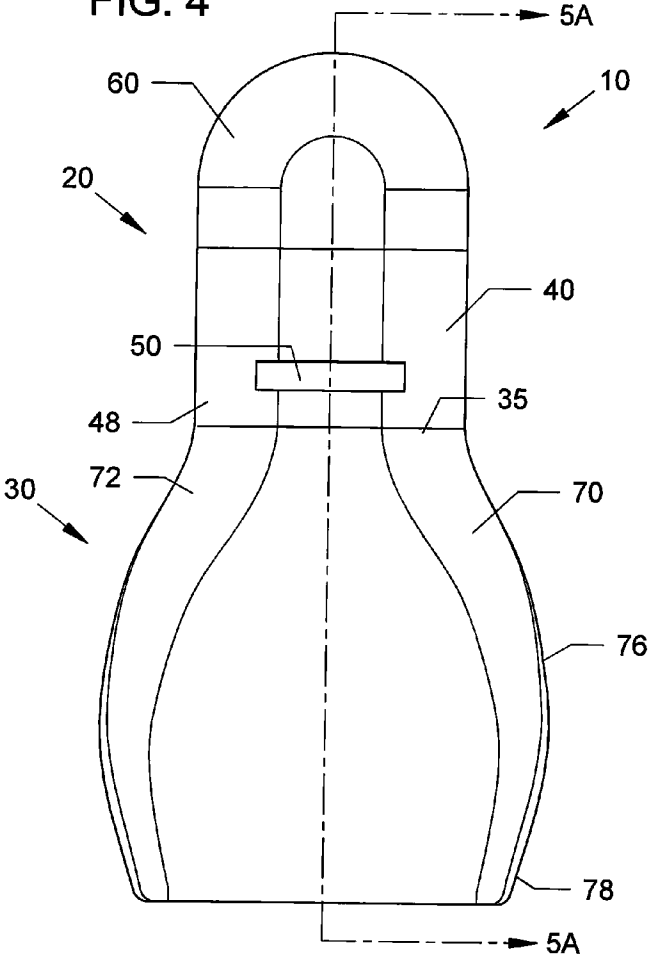
FIG. 4 is a rear view of the dual dispenser assembly of FIG. 1.
Figure 3:
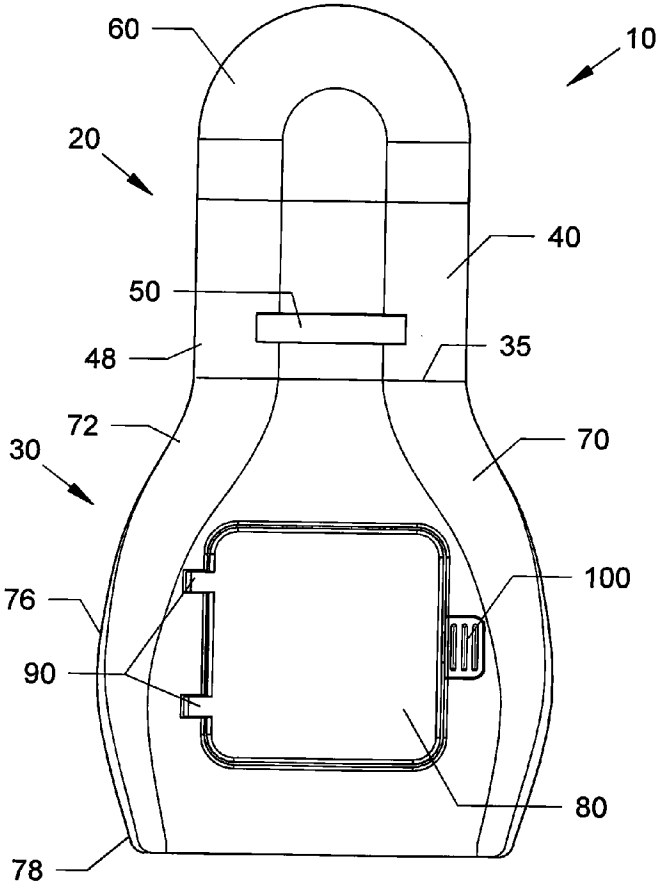
FIG. 3 is a front view of the dual dispenser assembly of FIG. 1.

10 Dual dispenser assembly. Front loading wipe configuration.
20 Modular deodorant dispenser.
30 Modular wipe dispenser.
35 Split line between dispenser assemblies.
40 Deodorant dispenser body.
42 upper step on side surface
48 lower portion
50 Feed wheel advances deodorant product for use.
55 slider actuator/lever can be used to advance deodorant product for use.
57 Slot in deodorant dispenser body for slider actuator.
60 Deodorant dispenser cover.
62 lower skirt portion
70 Wipe dispenser body.
72 neck portion
75 Wipe access opening.
76 lower mid portion
78 base
79 bottom
80 Wipe dispenser access door
85 Wipe dispense fingers improve access to individual wipes. (Prior Art)
90 Access door hinge.
100 Access door latch.
110 Typical individual moist wipe. (Prior Art)
120 Typical package of moist wipes. (Prior Art)
130 Male connecting post fits to the female connecting post on the underside of the deodorant dispenser via screw threads, snap, or other typical fasteners.
140 Threads on the outside of the male connecting post engage threads on the inside of the female post of the deodorant dispenser securing the two dispensers
150 Female connecting post on underside of the deodorant dispenser.
160 Threads on the inside of the female connecting post.
170 Rib formed on the inside of the female connecting post provides a positive snap to a similar rib formed on the outside of the male connecting post.
175 Rib formed on outside of male connecting post of wipe dispenser engages internal rib of the deodorant dispensers male connecting post
180 Deodorant product in cake form.
190 Threaded drive shaft is keyed to the feed wheel
200 Product platform.
210 Another Dual dispenser assembly.
220 Wipe dispenser assembly.
230 Alternate wipe dispenser access door.
235 Alternate access door hinge.
240 Alternate wipe access opening in loading door.
250 Alternate loading door for wipe packages.
260 Alternate loading door hinge.
270 Alternate package design possibility.
280 Alternate package design possibility.
290 Alternate package design possibility.
300 Alternate moist wipe package design can be configured into overall design.
310 Unpackaged wipes could be dispensed.
320 Typical packaged wipes could be dispensed.
330 Individually packaged wipes could be dispensed.
340 Alternate wipe package design showing a possible graphic.
350 #340 showing another possible graphic.
360 Alternate deodorant dispenser design showing a possible graphic.
370 #360 showing another possible graphic.
380 A-D Possible graphics on dispensers.
390 Dual dispenser assembly adapted to accept off the shelf roll-on deodorant.
395 Wipe dispenser with a cavity formed to grip an off the shelf roll-on deodorant
400 Cavity formed in the wipe dispenser for roll-on deodorant.
410 Roll-on deodorant product. (Prior Art)
420 Body of roll-on product fits into cavity of wipe dispenser #395.
430 Body of spray-on product fits into cavity of wipe dispenser #445.
440 Dual dispenser assembly adapted to accept an off the shelf spray-on deodorant product.
450 Cavity formed in the wipe dispenser for spray-on deodorant.
460 Spray-on deodorant product. (Prior Art) or roll-on or stick or liquid or powder FIG. 1 is an upper front right perspective view of a dual dispenser assembly 10, with one access door 80 in the front where moist wipes 110, 120, can be loaded and dispensed. FIG. 2 is an exploded perspective view of the dual dispenser assembly 10 of FIG. 1. FIG. 3 is a front view of the dual dispenser assembly 10 of FIG. 1. FIG. 4 is a rear view of the dual dispenser assembly 10 of FIG. 1. FIG. 5A is a cross-sectional view of the dual dispenser assembly 10 of FIG. 4 along arrows 5A.

Figure 5B:
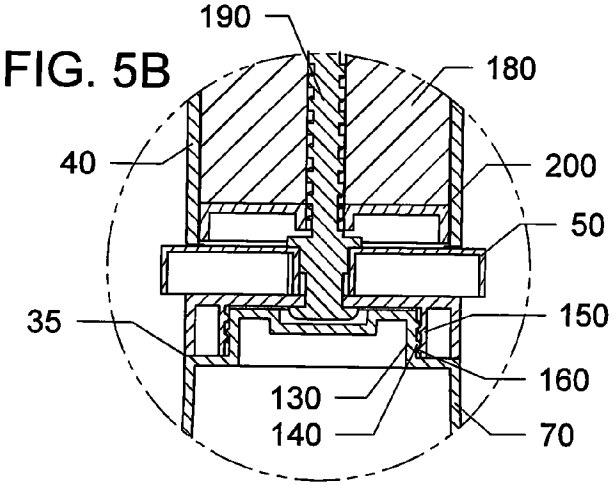
FIG. 5B is an enlarged view of a portion of FIG. 5A with a screw on attachment between the dispensers.
Figure 5C:
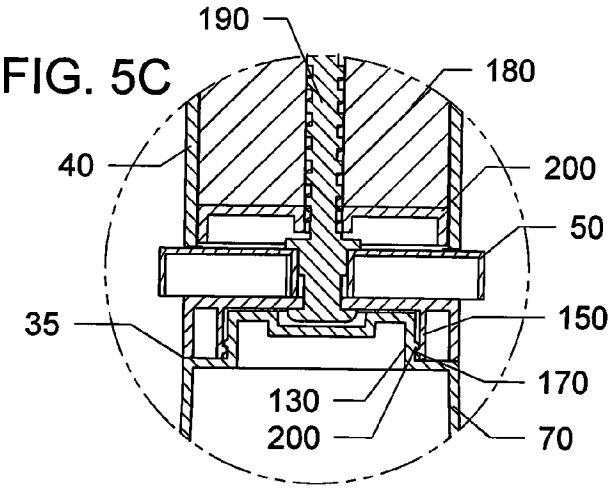
FIG. 5C is an enlarged view of a portion of FIG. 5A with a snap on attachment between the dispensers.
Figure 5A:
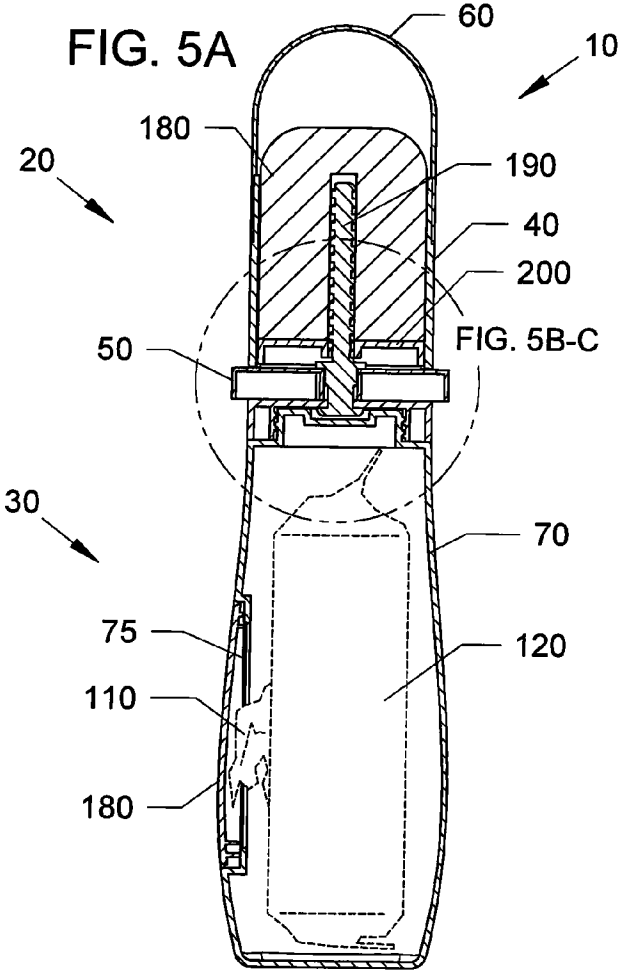
FIG. 5A is a cross-sectional view of the dual dispenser assembly of FIG. 4 along arrows 5A.

FIG. 5B is an enlarged view of a portion of FIG. 5A with a screw on attachment between the dispensers. FIG. 5C is an enlarged view of a portion of FIG. 5A with a snap on attachment between the dispensers.

Figure 7:
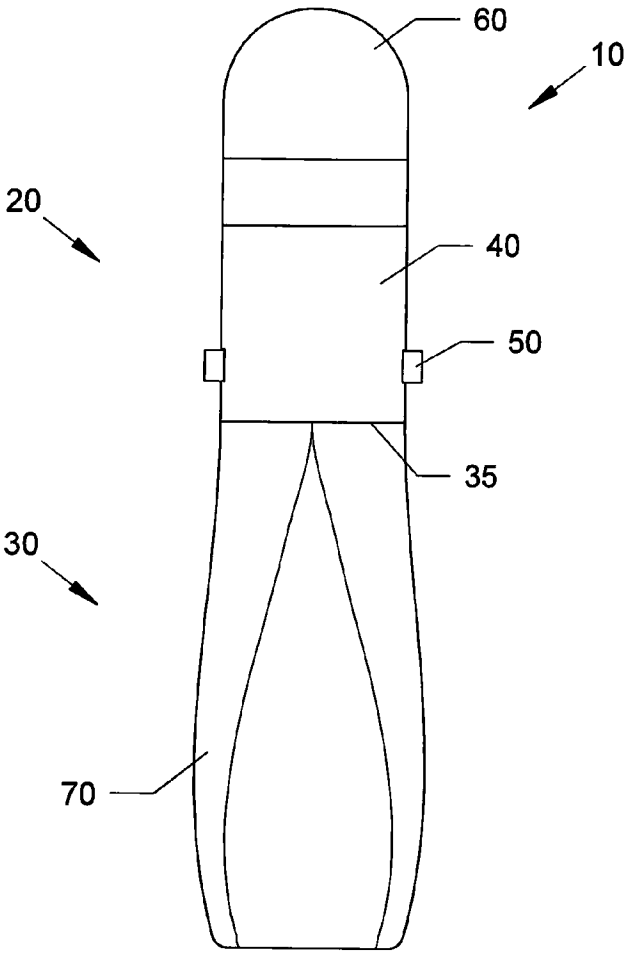
FIG. 7 is a right side view of the dual dispenser assembly of FIG. 1.
Figure 6:
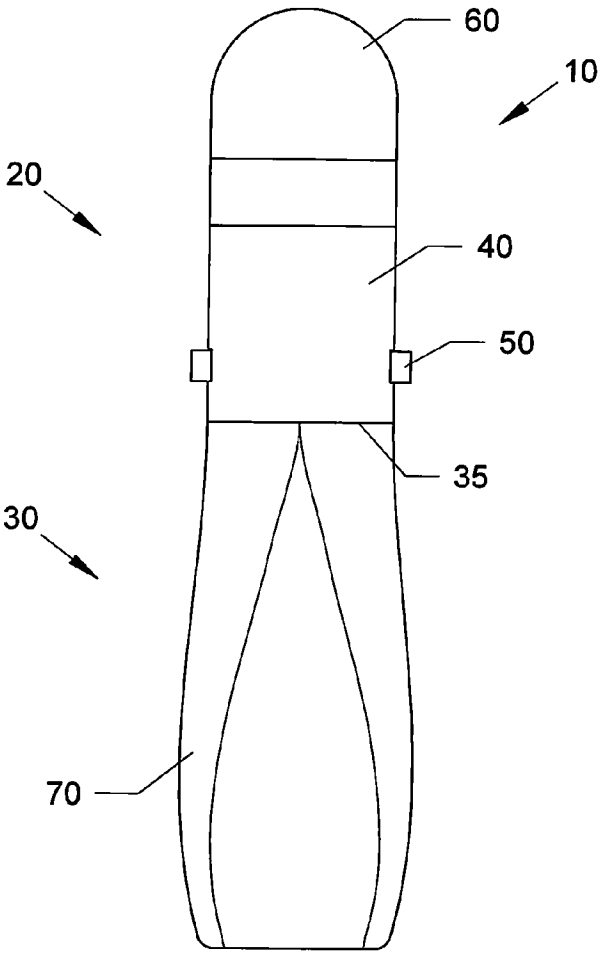
FIG. 6 is a left side view of the dual dispenser assembly of FIG. 1.
Figure 9:
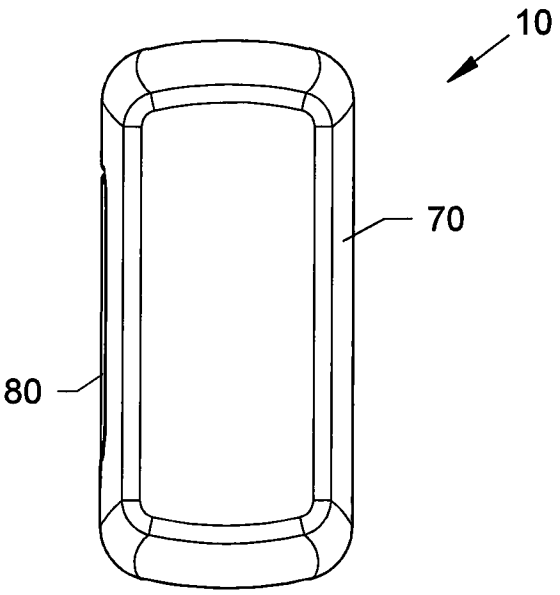
FIG. 9 is a bottom view of the dual dispenser assembly of FIG. 1.
Figure 8:
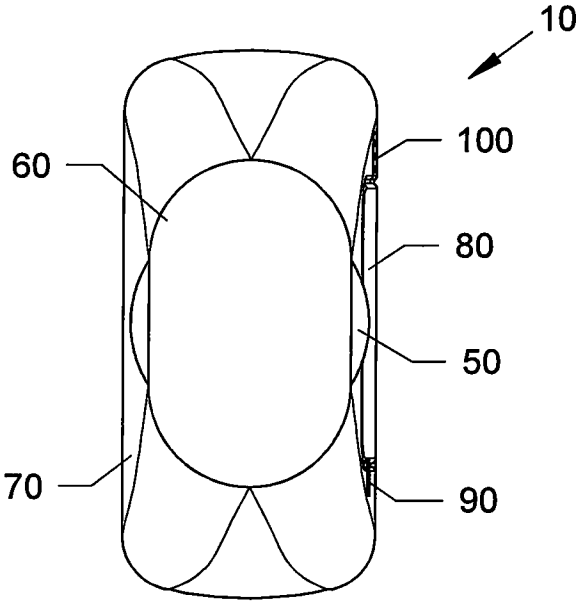
FIG. 8 is a top view of the dual dispenser assembly of FIG. 1.

FIG. 6 is a left side view of the dual dispenser assembly 10 of FIG. 1. FIG. 7 is a right side view of the dual dispenser assembly 10 of FIG. 1. FIG. 8 is a top view of the dual dispenser assembly 10 of FIG. 1. FIG. 9 is a bottom view of the dual dispenser assembly 10 of FIG. 1.

Figures 10, 11, 12:
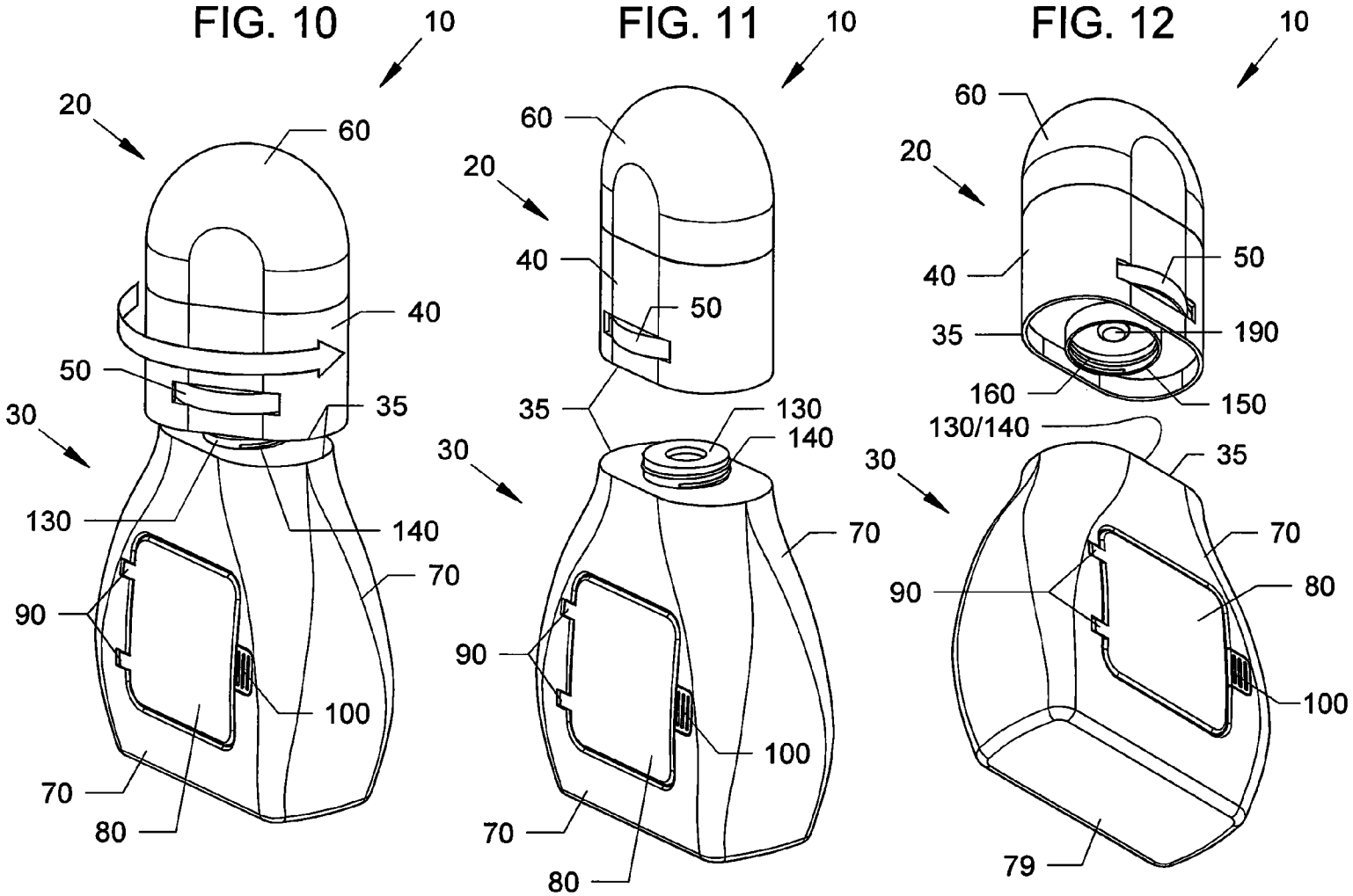
FIG. 10 is a right front perspective view of the dual dispenser assembly of FIG. 1 with the deodorant dispenser rotating counter-clockwise to separate from the wipe dispenser.
FIG. 11 is a right perspective view of the deodorant dispenser unscrewed from the wipe dispenser of FIG. 10, with exterior threads exposed.
FIG. 12 is a lower right perspective view of the deodorant dispenser unscrewed from the wipe dispenser of FIG. 11, with interior threads exposed.

FIG. 10 is a right front perspective view of the dual dispenser assembly 10 of FIG. 1 with the deodorant dispenser 20 rotating counter-clockwise to separate from the wipe dispenser 30. FIG. 11 is a right perspective view of the deodorant dispenser 20 unscrewed from the wipe dispenser 30 of FIG. 10, with exterior threads 140 exposed. FIG. 12 is a lower left perspective view of the deodorant dispenser 20 unscrewed from the wipe dispenser 30 of FIG. 11, with interior threads exposed.

Figure 14:
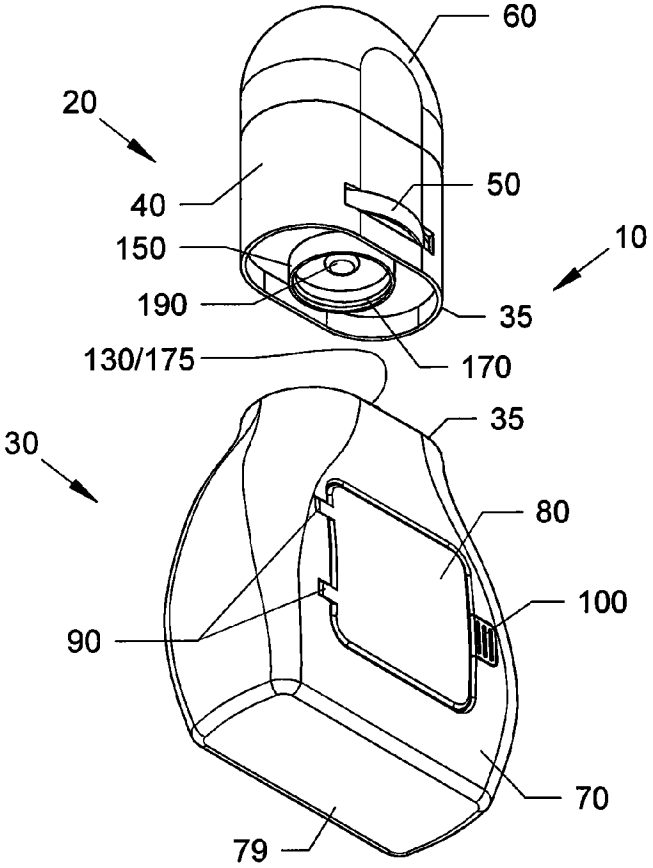
FIG. 14 is a lower left perspective view of the deodorant dispenser unsnapped from the wipe dispenser with the female socket and internal snap on rib of the deodorant dispenser exposed.
Figure 13:
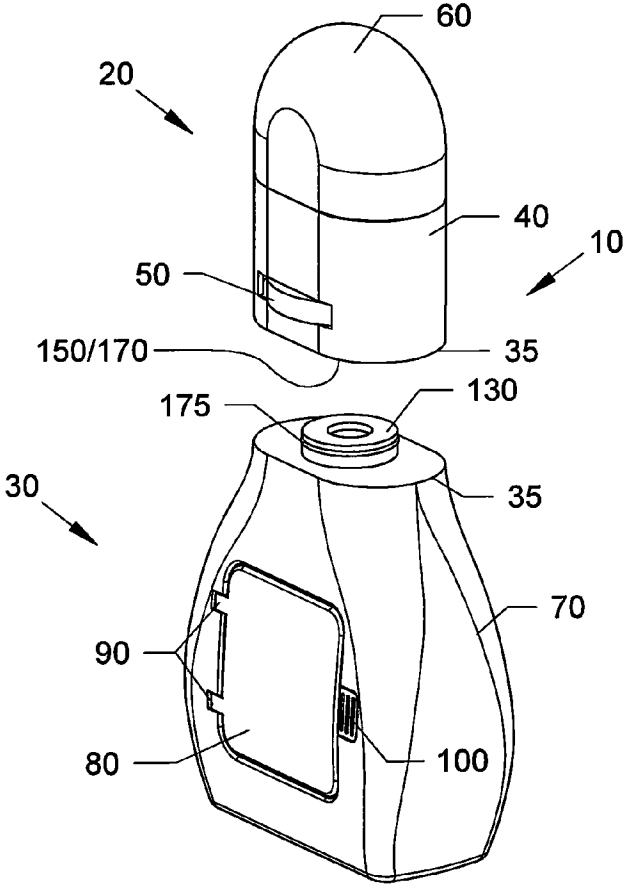
FIG. 13 is a right front perspective view of the dual dispenser assembly of FIG. 1 with the deodorant dispenser separated therefrom with the male member with external snap-on rib of the snap on attachment of the wipe dispenser exposed.

FIG. 13 is a right front perspective view of the dual dispenser assembly 10 of FIG. 1 with the deodorant dispenser 20 separated from the wipe dispenser 30 with the male member 130 with external snap-on rib 175 of the snap on attachment of the wipe dispenser 30 exposed. FIG. 14 is a lower right perspective view of the deodorant dispenser 20 unsnapped from the wipe dispenser 30 with the female socket 150 and internal snap on rib 170 of the deodorant dispenser 20 exposed.

Referring to FIGS. 1-14, the novel dual dispenser assembly 10 can include a front loading wiping configuration, that can have a modular deodorant dispenser 20 and wipe dispenser 30 that can attach and detach from one another. The deodorant dispenser 20 can include a body 40 that can have a generally oval configuration with rounded sides. The dispenser 20 can include removable cover 60 having a base skirt portion 62 that can slide on and frictionally attach to a stepped inside surface 42 of the body 40, which when removed exposes a deodorant product 180, such as but not limited to a dry cake type material, a wet stick material and the like.

A feed wheel 50 fixably attached to a threaded drive shaft 190 can be rotated to allow a platform 200 supporting the deodorant product 180 to move up from the bottom of the body 40. The threaded drive shaft 190 can engage an internal threaded channel inside of the deodorant product 180 so that the platform 200 is raised as the feed wheel 50 is rotated to advance the deodorant product 180 from the deodorant dispenser body 40.

The wipe dispenser 30 can include a wiper dispenser body 70 having an upper neck portion 72 having a diameter and foot print substantially identical to a lower portion 48 of the deodorant body 20. When the deodorant dispenser 20 is attached to the wipe dispenser 30, the top of the wipe dispenser 30 can be flush against the bottom of the deodorant dispenser 20 forming a split line 35.

The neck portion 72 of the wipe dispenser 30 can have shoulder sides that taper outward to a wider lower mid portion 76 having a convex exterior surface, and slightly taper inward to a base 78, which can have a width greater than neck portion 72. The bottom 79 of the wipe dispenser 30 can be flat so as to allow the dual dispenser assembly 10 to sit upright on a flat surface, such as a table, shelf, and the like.

Across a front of the wipe dispenser 30 can be a side access door 80 that can be hinged in place 90, by a live hinge, or other type of hinge mechanism. The side access door 80 can be used for allowing access to load loose wipes 110 or a package 120 of wipes into an interior chamber of the wipe dispenser body 70. The door 80 can be opened by a latch mechanism that can be molded into the body about the access door 80, which can be a push button or slide button configuration, or other type of releasable attachment mechanism.

Referring to FIGS. 1-5B, and 6-12, the top of the wipe dispenser body 70 can include a male connecting post (member) 130 having external threads 140 that can engage a female connecting post (socket) 150 with internal threads 160 on the underside of the deodorant dispenser body 40. The deodorant body 40 can be attached onto the top of the wiper body 70 by screwing the mateable threads 160 and 140 to one another, for example in a clockwise direction. Likewise, the deodorant body 40 can be separated from the wiper body 70 by unscrewing the threads 160 and 140 from one another by rotating the deodorant body 40 from the wiper body 70 in a counter-clockwise direction.

Referring to FIGS. 1-5A, 5C-9 and FIGS. 13-14, the deodorant body 40 can alternatively be attachable and be detachable from the wiper body 70 by snap mechanisms. For example, the male connecting post (member) 130 can have a rib 175 formed on the outside that can engage and snap about an internal rib 170 formed on the inside of the female connecting post (socket) 150. The snapable ribs 175, 170 can form an interference snap feature that can secure the two dispensers 20, 30 together, and allow the dispensers 20, 30 to be pulled apart and unsnapped from one another.

Figure 16:
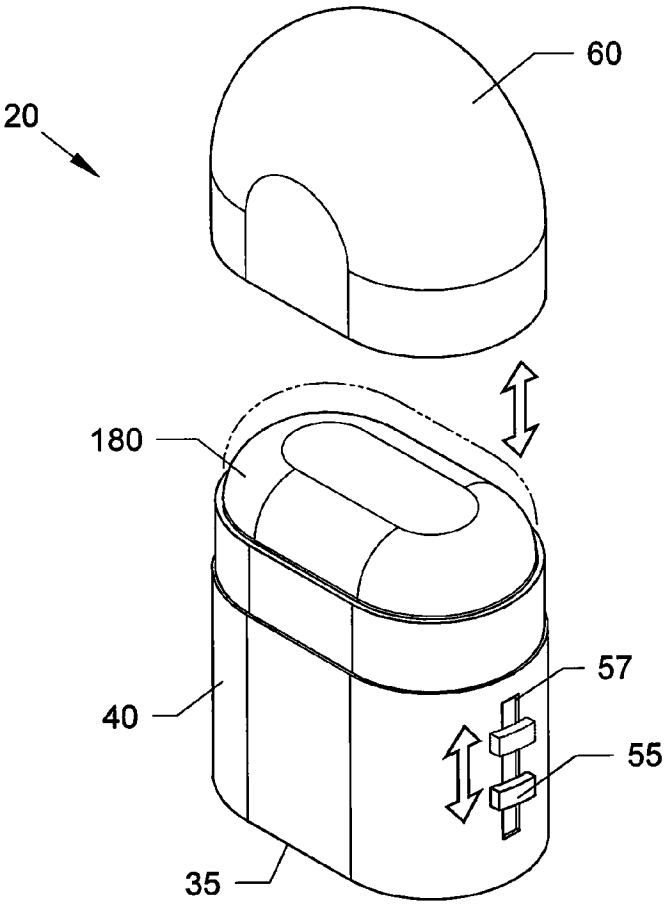
FIG. 16 is another perspective view of the deodorant dispenser of FIG. 15 with cap removed.
Figure 15:
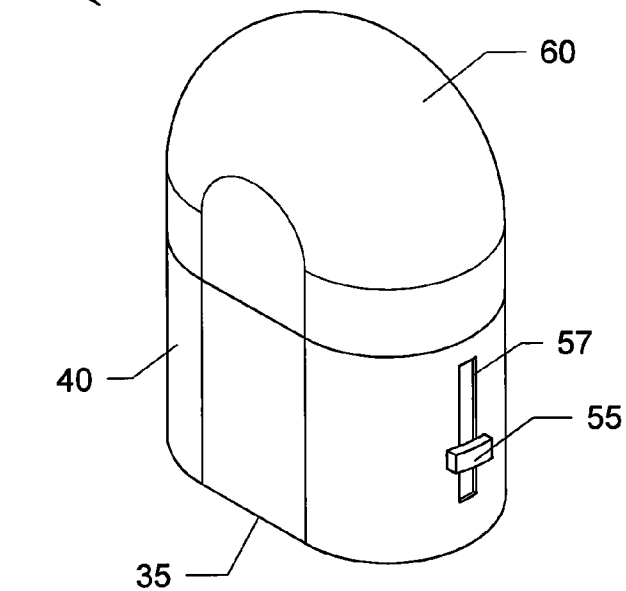
FIG. 15 is an upper right perspective view of the deodorant dispenser of the previous figures using a slide actuation lever.

FIG. 15 is an upper right perspective view of the deodorant dispenser 20 of the previous figures using a slide actuation lever 55 slidable within a slot 57 in the side of the deodorant body 40. FIG. 16 is another perspective view of the deodorant dispenser of FIG. 15 with cap 60 removed. The slide lever (actuator) 55 can be attached to the internal platform 200 to be used as a slide actuator to advance the deodorant body 180.

The dispenser bodies 40, 70 can be formed form injection molded plastic, or other types of molded plastic, and form a stiff plastic configuration or a configuration having a flexible configuration.

Figure 17:
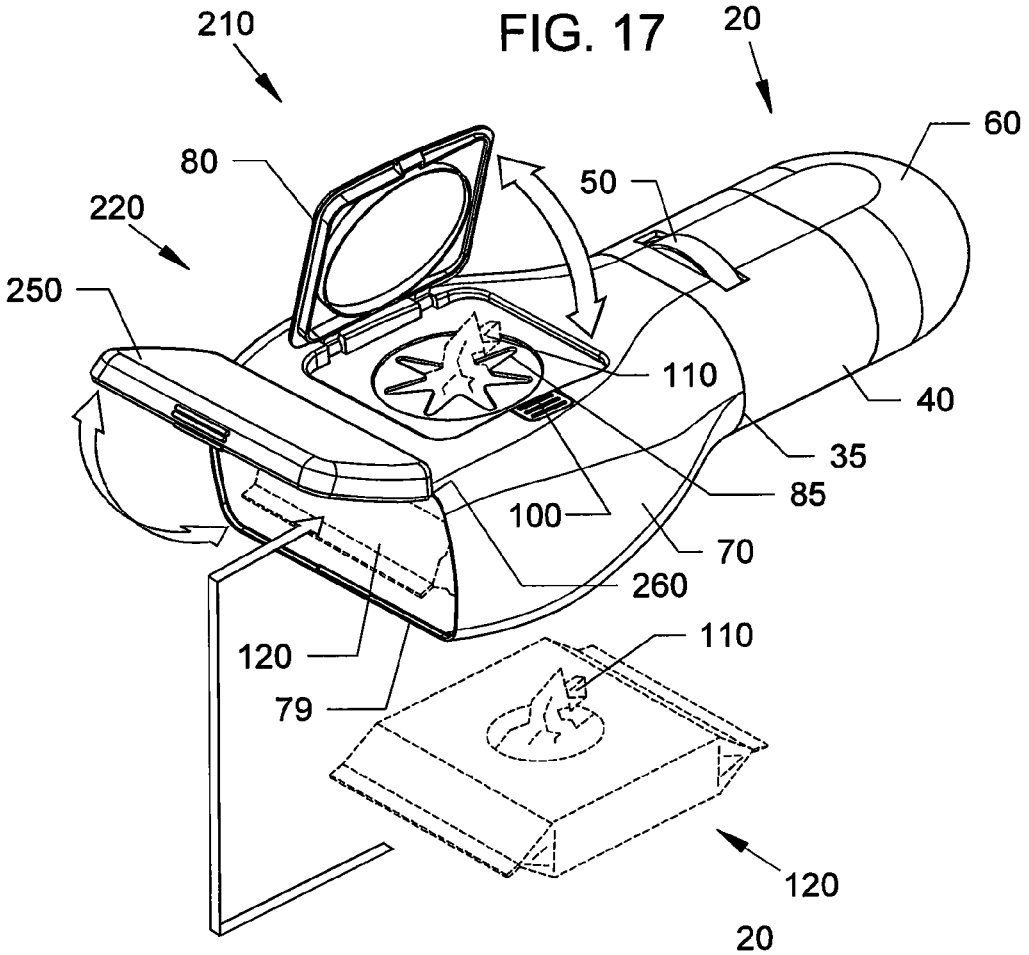
FIG. 17 is another perspective view of the dual dispenser of FIG. 1 with an alternative bottom loading door for the wipe dispenser, along with a rotating wheel actuator for the deodorant dispenser with both the wipe loading door, and wipe dispensing door open.

FIG. 17 is another perspective view of another dual dispenser 210 with an bottom loading wiper dispenser 220 having a bottom access door 250 with hinge 260 for loading and unloading the wipe package(s) 120 along with a rotating wheel actuator 50 for the deodorant dispenser 20 with both the wipe loading door 250, and wipe dispensing door 80 open.

Figure 18:
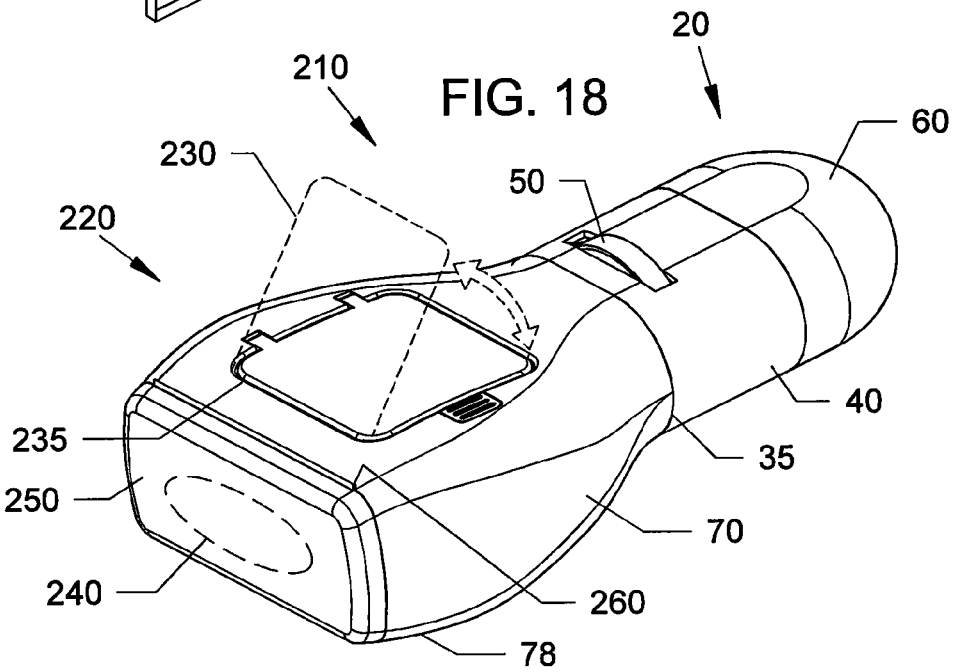
FIG. 18 if another perspective view of the dual dispenser of FIG. 17 with the bottom loading and side access doors closed, and another hinge configuration for the access door.

FIG. 18 is another perspective view of the dual dispenser 210 of FIG. 17 with the bottom loading and side access doors 230, 240 closed, and another hinge configuration 235 for the side access door 230. The door 250 can be hinged similar to the other door 80, and can be hinged 260 from the bottom 79. Additionally, a smaller access port 240 can be in the bottom 79 of the wiper dispenser 220 to allow for either or both loading and access to dispense wipes therefrom.

Figure 19:
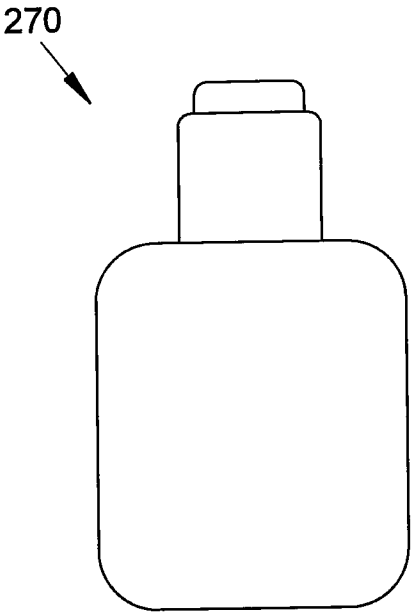
FIG. 19 is a front view of another dual dispenser with both the wipe dispenser and deodorant dispenser each having box configurations with rounded corners.

FIG. 19 is a front view of another dual dispenser 270 with both the wipe dispenser and deodorant dispenser each having box configurations with rounded corners.

Figure 20:
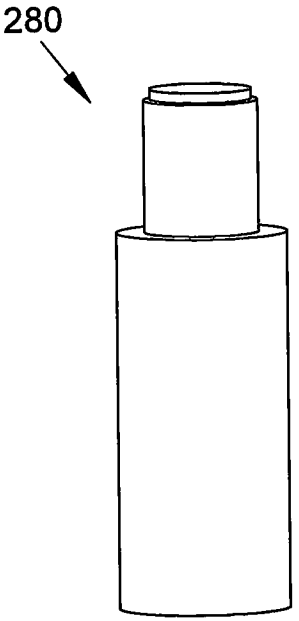
FIG. 20 is a front view of another dual dispenser with both the wipe dispenser and deodorant dispenser each having cylindrical configurations.

FIG. 20 is a front view of another dual dispenser 280 with both the wipe dispenser and deodorant dispenser each having cylindrical configurations.

Figure 21:
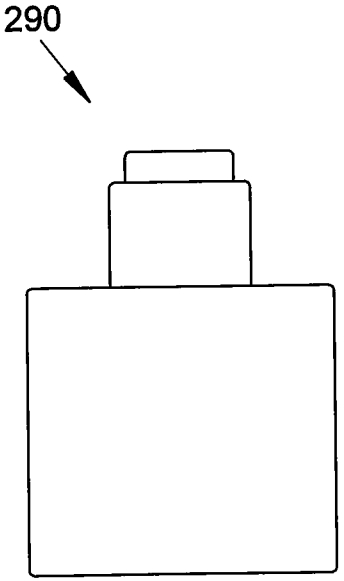
FIG. 21 is a front view of another dual dispenser with both the wipe dispenser and deodorant dispenser each having box configurations with sharp corners.

FIG. 21 is a front view of another dual dispenser 290 with both the wipe dispenser and deodorant dispenser each having box configurations with sharp corners.

Figure 22:
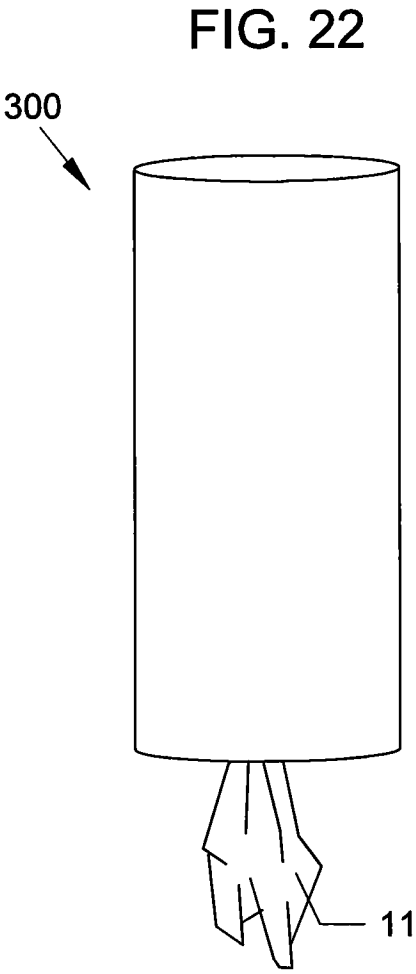
FIG. 22 is a front view of a wipe dispenser for use with the dual dispenser having a cylindrical configuration with bottom removable wipes.

FIG. 22 is a front view of a wipe dispenser 300 for use with the dual dispenser having a cylindrical configuration with bottom removable wipes.

Figure 23:
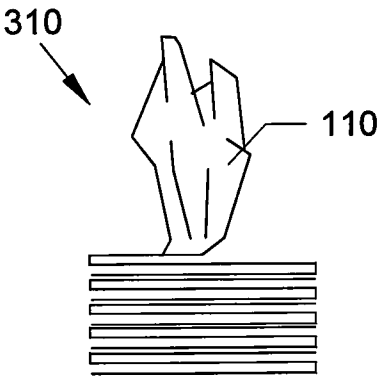
FIG. 23 is a front view of unpackaged wipes that can be stored in the wipe dispensers of the preceding embodiments.

FIG. 23 is a front view 310 of unpackaged wipes 110 that can be stored in the wipe dispensers of the preceding embodiments.

Figure 24:
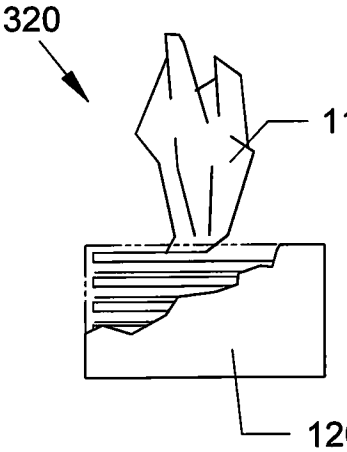
FIG. 24 is a front view of packaged wipes that can be stored in the wipe dispensers of the preceding embodiments.

FIG. 24 is a front view of packaged wipes 120 that can be stored in the wipe dispensers 70, 220 of the preceding embodiments.

Figure 25:
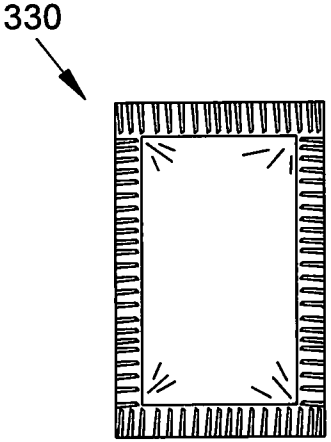
FIG. 25 is a front view of individually packaged wipes that can be stored in the wipe dispensers of the preceding embodiments.

FIG. 25 is a front view of individually packaged wipes 330 that can be stored in the wipe dispensers of the preceding embodiments.

Figure 28:
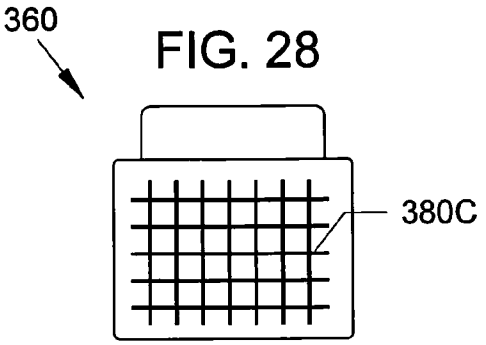
FIG. 28 is a front view of the dual dispensers with a table pattern graphic exterior design.
Figure 29:
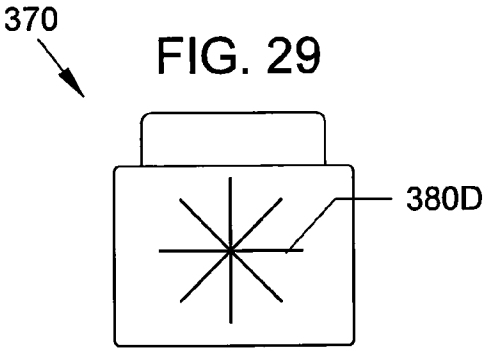
FIG. 29 is a front view of the dual dispensers with a star graphic exterior design.
Figure 26:
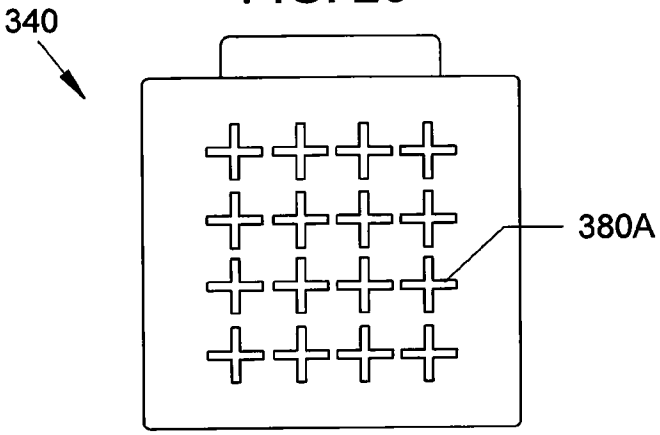
FIG. 26 is a front view of the dual dispensers with a cross graphic exterior design.
Figure 27:
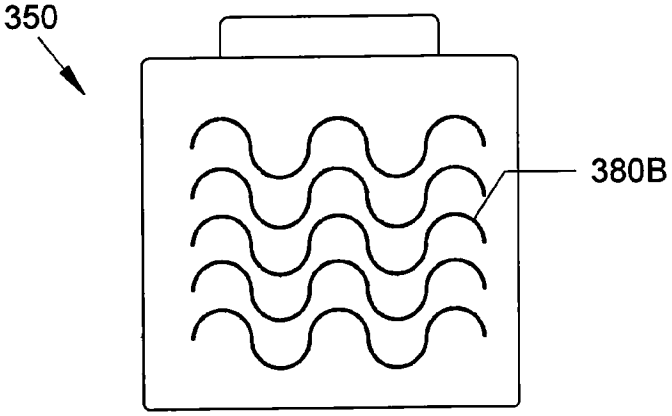
FIG. 27 is a front view of the dual dispensers with a curve lines graphic exterior design.

FIG. 26 is a front view of the dual dispensers 340 with a cross graphic exterior design 380A. FIG. 27 is a front view of the dual dispensers 350 with a curve lines graphic exterior design 380B. FIG. 28 is a front view of the dual dispensers 360 with a cross-pattern graphic exterior design 380C. FIG. 29 is a side view of the dual dispensers 370 with a star graphic exterior design 380D.

FIGS. 26-29, exemplify the novelty of selecting decorative mix match compartments having different patterns that can appeal to customers in a younger demographic increasing sales for the manufacturer. Other patterns and designs can be selected as needed.

Figure 31:
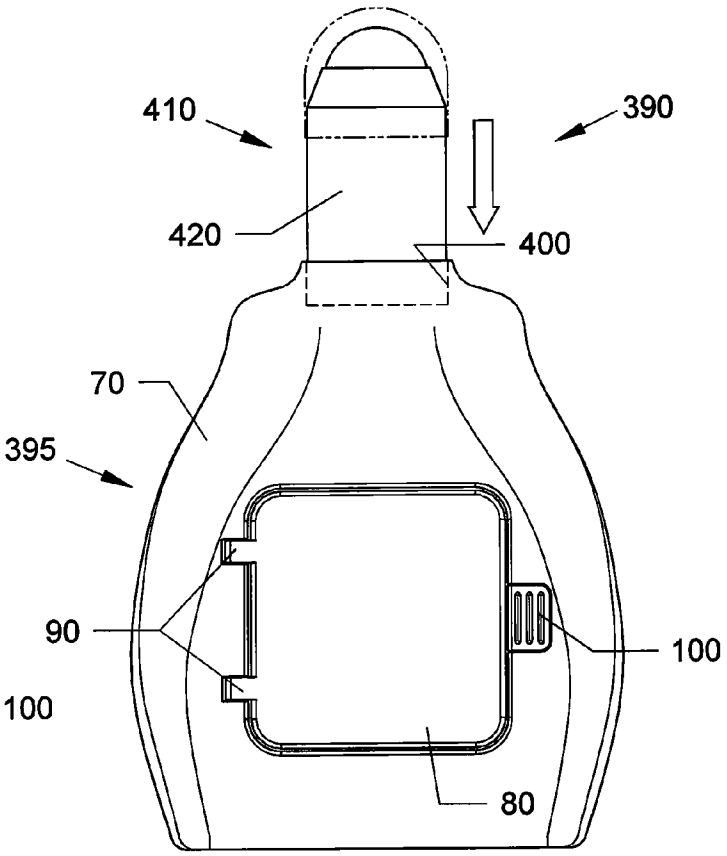
FIG. 31 is a front assembled view of a prior art cylindrical deodorant dispenser being attached to the novel wipe dispenser of FIG. 30.
Figure 30:
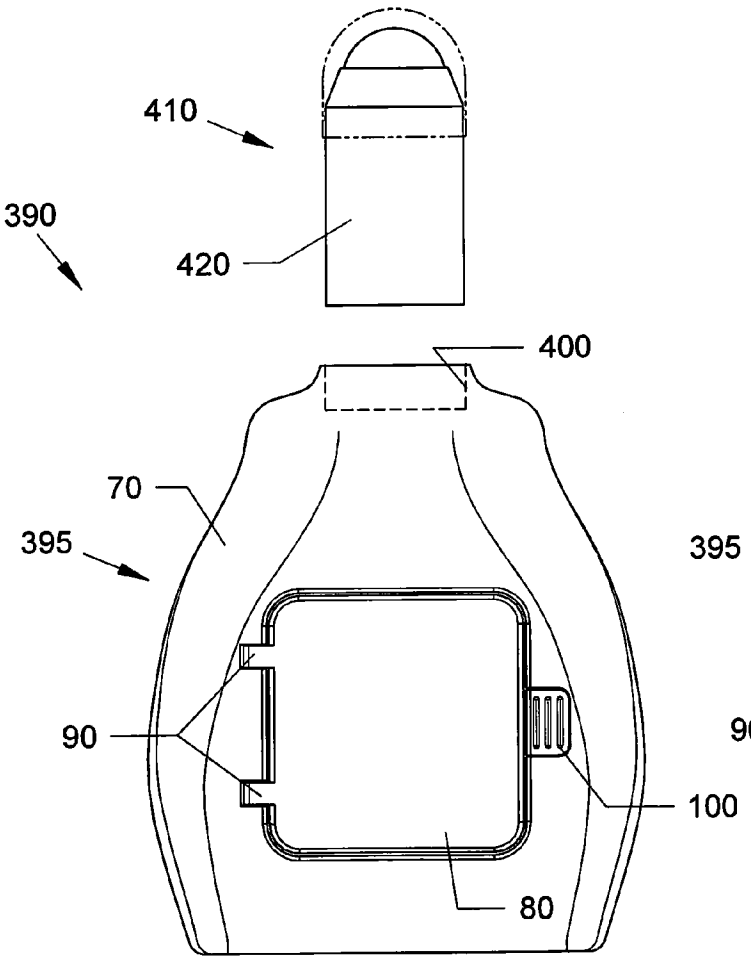
FIG. 30 is a front exploded view of another embodiment of the dual dispensers with a standard cylindrical deodorant dispenser of the prior art being separated from a novel wipe dispenser container.

FIG. 30 is a front exploded view of another embodiment of the dual dispensers 390 with a standard cylindrical deodorant dispenser 410 of the prior art, such as but not limited to a roll-on dispenser 420, stick dispenser or other type of known prior art deodorant, being separated from a novel wipe dispenser container 395. FIG. 31 is a front assembled view of a prior art cylindrical deodorant dispenser 420 being attached to the novel wipe dispenser 395 of FIG. 30 by inserting the bottom of the prior art dispenser 420 into an upper cavity 400 of the neck portion of the wipe dispenser 395.

Figure 33:
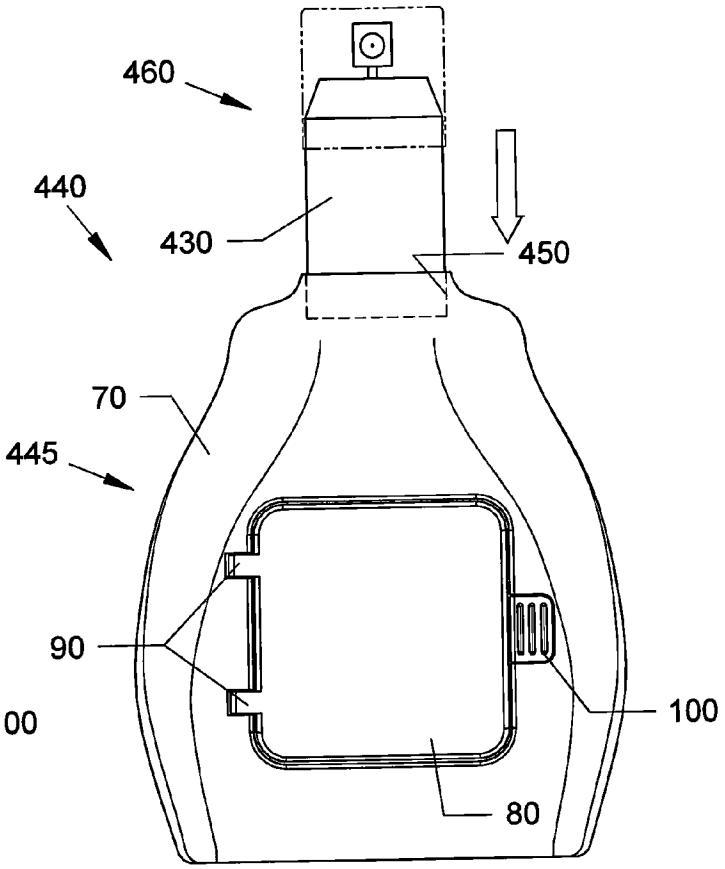
FIG. 33 is a front assembled view of the deodorant dispenser and wipe dispenser of FIG. 32 attached to one another.
Figure 32:
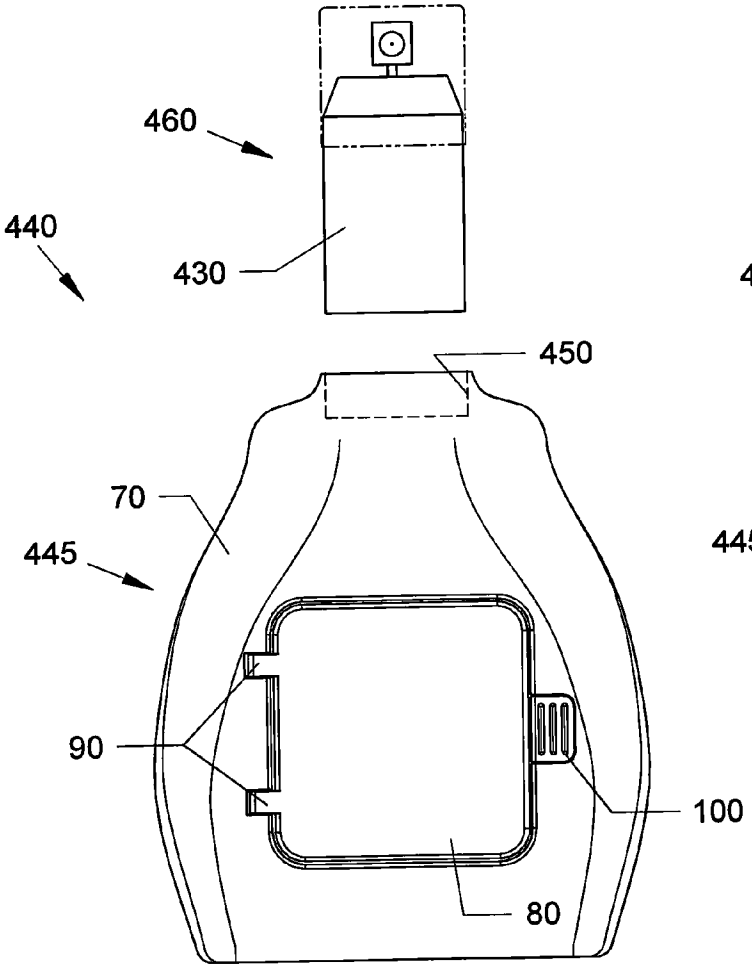
FIG. 32 is a front exploded view of another embodiment of a dual dispenser assembly having a spray deodorant dispenser.

FIG. 32 is a front exploded view of another embodiment of a dual dispenser assembly 440 having a prior art spray deodorant dispenser 460 with a lower portion of the deodorant body 430 being able to slidably fit into an upper cavity 450 in the top of the wiper dispenser 445. FIG. 33 is a side assembled view of the deodorant dispenser and wipe dispenser of FIG. 32 attached to one another.

While the drawing embodiments show the deodorant dispenser 20 and wipe dispenser 30 being attachable and detachable from one another, the invention can be used with the dispensers 20 and 30 being permanently joined to one another as one unit. The split line 35 does not necessary need to be present if the dispensers 20, 30 are permanently joined to one another.

Although the upper dispenser is described as being a deodorant dispenser, the invention can be used with other products, such as but not limited to other types of antiperspirant, and other types of personal body care products, such as sunscreen, suntan lotions, cosmetics, moisturizers, shaving cream dispensers (cans), toothpaste tubes, and the like, and any other types of stick products, and the like.

While the lower dispenser is described as housing wipes, the lower dispenser, can container other products, such as but not limited to wet or dry wipes, cleaning pads, tissues, razor blades, ear cleaning cotton and cotton tips, other toiletries and healthcare products, and the like.

The invention can be used with different sizes of various healthcare products, and toiletry products, both for home use and travel. The sizes can range from full size products to travel size products.

While the drawings show a deodorant dispenser on top, with wipes on the bottom, the dispenser product locations can be reversed.

Although the drawings show some shapes, the invention can be used with any shapes for the dispenser bodies. The invention can have an aesthetic appearance and be sized to be easily moved and carried.

While a preferred dimension can include preferably a range from approximately 5 to approximately 9 inches high to approximately 2 to approximately 4 inches wide, the dispensers and assemblies can be made larger or smaller than these dimensions as needed. The invention can be reused over time, and be used during travel or home use, or both.

The term "approximately" can be +/−10% of the amount referenced. Additionally, preferred amounts and ranges can include the amounts and ranges referenced without the prefix of being approximately.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A dual compartment container for deodorants and wipes, comprising:

an upper compartment having an upper end with a single dispensing port, and a lower end with a lower fastener, the upper compartment with an upper storage space consisting of a deodorant stored inside the upper storage space so that the deodorant is dispensed from the dispensing port;

a lower compartment having an upper end with an upper fastener, and a lower end, the lower compartment with a lower storage space consisting of a plurality of wipes stored inside the lower storage space, the lower end forming a base for allowing the dual compartment to stand upright with the upper compartment above the lower compartment, and the upper compartment to be attached and detached from the lower compartment by attaching and detaching the lower fastener and the upper fastener from one another, with the dual compartment container capable of being held in one's hand.

2. The dual compartment container of claim 1, wherein the lower fastener and the upper fastener include:

a male member having exterior threads and a female member having internal socket threads, wherein the male member screws into the female member to attach the upper compartment to the lower compartment.

3. The dual compartment container of claim 1, wherein the lower fastener and the upper fastener include:

a male member having at least one exterior snap on rib: and a female member having at least one internal snap on rib, wherein the male member snapably attaches into the female member to attach the upper compartment to the lower compartment.

4. The dual compartment container of claim 1, further comprising:

a removable cover for covering the single dispensing port in the upper end of the upper compartment to allow the deodorant to be dispensed therefrom; and a side access door covering a side dispensing opening in the lower compartment for allowing the wipes to be individually dispensed therefrom.

5. The dual compartment of claim 4, wherein the lower compartment includes:

the upper end having a diameter substantially identical to a diameter of the lower end of the upper compartment and tapering outward to a convex side portions adjacent to a base portion.

6. The dual compartment of claim 4, further comprising:

a loading door on the lower end of the lower container for loading wipes into the lower container.

7. The dual compartment of claim 6, wherein the lower compartment includes:

the upper end having a diameter substantially identical to a diameter of the lower end of the upper compartment and tapering outward to a convex side portions adjacent to a base portion.

8. The dual compartment container of claim 4, further comprising:

a rotatable wheel for controlling the dispensing of the deodorant.

9. The dual compartment container of claim 4, further comprising:

a slidable lever for controlling the dispensing of the deodorant.

10. The dual compartment of claim 1, wherein the upper compartment includes:

a generally oval configuration with rounded top cover.

11. The dual compartment of claim 10, wherein the lower compartment includes:

the upper end having a diameter substantially identical to a diameter of the lower end of the upper compartment and tapering outward to a convex side portions adjacent to a base portion.

12. The dual compartment of claim 1, wherein the upper compartment includes:

a generally tubular configuration with rounded top cover.

13. The dual compartment of claim 12, wherein the lower compartment includes:

the upper end having a diameter substantially identical to a diameter of the lower end of the upper compartment and tapering outward to a convex side portions adjacent to a base portion.

14. A dual deodorant and wipes device, consisting of:

a handheld container with a first separate chamber and a second separate chamber attachable and detachable from one another, the first separate chamber consisting of a single storage space and a single dispensing port with a cover, and a single dispensing member for controlling dispensing of a product stored inside the single storage space, the product consisting of a deodorant stored inside the storage space, the second separate chamber consisting of a single storage space with at least one access door to the single storage space and a single product stored inside the single storage space, the single product consisting of a plurality of wipes, and a pair of fasteners for allowing the first storage chamber to be attached to and detached from the second storage chamber, and wherein the at least one access door allows for insertion and removal of the plurality of the wipes from the second separate chamber.

15. The dual device of claim 14, wherein the at least one access door to the second storage chamber is a side door for allowing the wipes to be dispensed therefrom.

16. The dual device of claim 15, wherein the at least one access door to the second storage chamber is a bottom access door on a bottom of the second storage chamber for allowing the wipes to be loaded into the second storage chamber.

17. The dual device of claim 14, wherein the pair of fasteners includes mateable threadable fasteners for allowing the first separate chamber and the second separate chamber to screw onto one another or unscrew and separate from one another.

18. The dual device of claim 14, further comprising:

snapable ribs for allowing the first separate chamber and the second separate chamber to snap onto one another or unsnap and separate from one another.

* * * * *